US005110447A

United States Patent [19]

MacWilliams et al.

[11] Patent Number: 5,110,447

[45] Date of Patent: May 5, 1992

[54] PROCESS AND APPARATUS FOR PARTIAL UPGRADING OF A HEAVY OIL FEEDSTOCK

[75] Inventors: William A. MacWilliams; William Eadie, both of Edmonton, Canada

[73] Assignee: Kasten, Eadie Technology Ltd., Edmonton, Canada

[21] Appl. No.: 242,535

[22] Filed: Sep. 12, 1988

[51] Int. Cl.[5] ..... C10G 9/00

[52] U.S. Cl. ..... 208/106; 208/125; 208/80; 208/81; 208/82; 208/343; 208/353; 208/365

[58] Field of Search ..... 208/80, 81, 82, 106, 208/125, 343, 353, 365

[56] References Cited

U.S. PATENT DOCUMENTS

| | | | |
|---|---|---|---|
| 2,099,718 | 11/1937 | Bahlke et al. | 208/82 |
| 2,310,317 | 2/1943 | Roberts | 208/82 |
| 2,323,206 | 6/1943 | Florez | 208/82 |
| 2,330,760 | 9/1943 | Thomsen | 208/82 |
| 3,919,074 | 11/1975 | Gatsis | 208/48 |
| 4,087,354 | 5/1978 | Hessler | 208/353 |

FOREIGN PATENT DOCUMENTS

| | | | |
|---|---|---|---|
| 0058504 | 5/1978 | Japan | 208/365 |

*Primary Examiner*—Helane E. Myers
*Attorney, Agent, or Firm*—Ernest Peter Johnson

[57] ABSTRACT

The invention involves visbreaking heavy oil under mild conditions in a vertical vessel containing a vertical elongate ring spaced inwardly from the vessel wall to form an outer open-ended annular chamber and an inner open-ended soak chamber. Heavy oil at 220°-600° F. is fed to top of annular chamber. A mixture of visbroken residuum and heavy oil at 730°-800° F. is fed to top of soak chamber. There is heat transfer through the ring from the soak liquid to the annulus liquid to assist in maintaining mild temperature in the soak chamber. The two streams mix in the base of the vessel whereby the visbreaking reaction is quenched. Part of the product is recycled and heated to provide the feed to the soak chamber.

11 Claims, 4 Drawing Sheets

PROCESS AND APPARATUS FOR PARTIAL UPGRADING OF A HEAVY OIL FEEDSTOCK

FIELD OF THE INVENTION

The invention relates to treating produced heavy crude oil in a coalescing treater and visbreaking the treated heavy oil under mild conditions in a compartmentalized flash separator to produce a pipelineable product.

BACKGROUND OF THE INVENTION

The invention finds application in the treatment of the production streams of heavy oil reservoirs, particularly where thermal recovery techniques are utilized.

Exemplary thermal recovery techniques include steam injection, in-situ combustion and cyclic steam injection ("huff and puff"). Such techniques focus on reducing the viscosity of the immobile oil in place, so that it can be driven to a production well and recovered.

Typically, the composition of the production stream from a thermal recovery process can vary, from a stream comprising oil, water, gases and solids in an emulsified state to a relatively clean but viscous oil. The composition, and also the viscosity of the produced stream, thus can vary widely and depend to some extent on the type or stage of production. For example, when employing a 'huff and puff' operation, in the initial stages of the production cycle, water and sand concentrations will be high. However, as the well continues to produce, the oil content will increase, with concomitant diminuation of solids and water weights. To offset this advantage, the temperature of the produced stream decreases as the cycle progresses, with resultant increase in viscosity thereof.

A typical production stream would comprise about 20% water content and 5% solids content. However, in order to be acceptable to meet pipeline specifications, the basic sediments plus water content (BS & W) must not exceed 0.5% (by volume).

Additionally, the produced oil stream could well be at a temperature of 50° to 100° C. and display a viscosity of 5,000 cps. In order to meet current pipe line requirements it is stipulated that the viscosity of the stream be 250 cps at 20° C.

Hence, it is necessary to clean the produced crude oil stream by removing water and solids therefrom and, by some means, to obtain a reduction in the viscosity of the heavy oil, so as to render it transportable in a pipe line.

It is conventional practice to subject the production stream initially to a free water knock-out step, by retaining the stream in a holding vessel where a large portion of the water content separates out under gravity. After this step, the water concentration of the production stream is typically 10%. However, this residual water is in a non-readily disengageable emulsified state. Therefore it is necessary to subject the stream to a more rigorous treatment. This is done by passing the oil/water emulsion stream to a phase separation vessel, termed a coalescing treater. In the treater, the oil is heated and admixed with emulsion-breaking chemicals, if necessary, to separate the water phase and solids from the lighter oil phase. Typically, once treated, the relatively pure oil exhibits a BS & W content below 0.5% by weight.

The treater vessel per se typically comprises a horizontal cylindrical vessel forming a sump portion at its lower end. In smaller units the treater vessel may be vertically disposed. Heating means, usually fire tubes, are provided to heat the vessel contents to the requisite temperature.

Operating conditions of the treater commonly comprise a pressure of up to 100 psig and temperature range of 50° to 65° C. The low temperature is maintained to ensure that the loss of light liquid hydrocarbons entrained in the vented gas product is minimized. Additionally, equipment problems arise when one attempts to operate fire tubes at higher temperatures.

After processing in a conventional treater, the pure heavy 'treated' oil typically exhibits a viscosity in the range 5,000–25,000 cps at 20° C.—although the actual viscosity of the oil, because of its elevated temperature, is somewhat lower.

As the viscosity of the treated oil fails to meet pipe line specifications, it has been the practice of oilfield operators to lower the viscosity thereof by addition thereto of a light hydrocarbon diluent. Typically, the diluent comprises condensates from a natural gas well or gas recovery plant. The dilution ratio required varies from one heavy oil reservoir to another, however it can be of the order of 20–40% by volume. A small portion of the diluent may be added upstream of the treater.

The principal disadvantage of this practice resides in the high costs of purchasing the diluent and transporting it to the well site and subsequently pumping it to the refinery site. Additionally, it is acknowledged that supplies of condensate are decreasing, whereas demand therefor remains high.

Before arriving at the present invention, applicant's original concept was to generate diluent at the well head and inject components of the formed diluent as a high temperature gaseous solvent into the reservoir, thereby mobilizing the oil contained therein. However, a study suggested that such a process would not be economically viable at this time and the concept was modified.

Applicants then considered the possibility of providing an on-site heavy oil partial up-grading process wherein either the viscosity of the oil would be reduced in the up-grading process or a diluent would be generated from the production stream. This would reduce or eliminate the necessity of purchasing the diluent and transporting it to the well site.

Consideration was given to existing processes for up-grading heavy oil. Prior art processes for upgrading heavy oil may be broadly classified as either refining with carbon elimination as a solid or refining without carbon rejection. The first class includes coking and heavy solvent de-asphalting processes. The second class encompasses thermal processes, exemplary of which are visbreaking, hydrovisbreaking and catalytic processes.

Delayed coking is a well known process in the art. It is directed toward the production of distillates by rejection of excess carbon in the form of coke. Traditionally, delayed coking takes place at pressures of about 10–20 psig and temperatures in the range of 800°–850° F. (425° to 450° C.).

Visbreaking involves the partial thermal decomposition of long hydrocarbon molecular chains by cleavage thereof into shorter chains. The extent, or severity, of a visbreaking process is parametric, depending upon reaction (or retention) time, temperature and pressure. Conventional visbreaking operates at a pressure in the range of 50–200 psig at temperatures ranging from 780°–840°

F. (415° to 450° C.). Typical retention times range from a few minutes to 2 hours. Conventional visbreaking is normally associated with refineries and consists of passing a heavy oil or the bottoms from a topping still through a single pass coil in a direct fired heater. The heater effluent can go to a fractionation column or be blended with other lighter feed streams. A thermal quenching occurs which prevents the reaction from proceeding to the point of producing unwanted coke. Preheating and partial recycle may also be employed to improve efficiency and control.

With this background in mind, we have sought to devise a process which would provide the extent of cleaning and viscosity reduction needed to approach or meet pipe line specifications for oil over approximately 12 API and reduce the diluent requirements for oil below 12 API, which process would be characterized by:

- minimal coke production;
- mild conditions, so that high pressure equipment would not be needed;
- flexibility, to cope with feeds having varying compositions, flow rates and pumping requirements;
- adaptability for use on a small scale at a well or battery site in the oilfield or pipeline receiving station; and
- simplicity of operation.

SUMMARY OF THE INVENTION

In accordance with the present invention, there is provided a process and apparatus for cleaning and reducing the viscosity of a heavy oil production stream; preferably to convert it to a form acceptable to a pipeline. The apparatus is preferably adapted for use in the oilfield at a well or battery site.

It will be noted that the heavy oil feedstock of the process of the present invention, hereinafter termed 'feedstock', comprises an oil production stream, preferably a heavy oil stream after it has been subjected to a free-water knockout treatment. Such a treatment is conventional in the art. Further, it is to be understood that by the term 'treated oil' is meant the product leaving a coalescing treater into which the feedstock is fed and treated in accordance with a preferred form of the invention. Preferably, this product is a blend comprising: feedstock, from which contained solids and water have been separated; recycled light hydrocarbon fractions from a visbreaking step; and, optionally re-cycled visbroken residuum.

The invention is centered upon but not restricted to combining at an oilfield site two interdependent processes which advantageously feed each other to yield beneficial cleaning and viscosity reduction and increased API gravity of the previously defined feedstock. The first process involves treating the feedstock in a coalescing treater in a novel manner. The second process involves partially thermally decomposing the treated oil from the treater under mild conditions (i.e. "visbreaking" in novel manner and vessel). Preferably the overhead light hydrocarbon vapour stream from the visbreaking process is partially condensed and at least part of the hot gassy condensation product is recycled to the inlet of the treater, to provide heating, mixing and dilution of the oil feedstock. Preferably, part of the hot residuum product from the visbreaking process is also recycled to the inlet of the treater, to provide additional heat to the mixture. The overhead vapour stream from the treater is preferably cooled and partially refluxed to return contained heavier fractions to the treater mixture.

By supplying heat to the treater contents by the medium of fluids recycled from the visbreaking process, the need for fire tubes in the treater may be eliminated or reduced and the treater may be operated at a much higher temperature than that which would conventionally be used if fire tubes alone were used. Thus, in the front end of the treater the feedstock is mixed with light hydrocarbon diluent and heated to relatively high temperature (e.g. 180° F.). This is done in order to disperse emulsions and increase the gravity difference between oil and water. In the settling compartment of the treater, water and solids are thus separated by gravity with relatively high efficiency. Also, of course, the viscosity of the feedstock is greatly reduced with a concomitant increase in API gravity due to its relatively dramatic temperature increase.

When the treater process is operated in this manner, a treated product may be obtained which is capable of meeting the previously mentioned pipe line specification with respect to BS & W.

With feedstocks above 12° API, no additional dilution with condensate is required. However when the feedstock is below about 12° API, a viscosity reduction is provided using this process. In order to meet pipeline specifications it will usually be necessary to add condensates as a diluent.

The visbreaking process and apparatus are novel in themselves. The visbreaking process is fed treated oil and conducted so as to minimize or eliminate the formation of coke. Use of untreated oil in the process would deleteriously affect the heat balance and lead to rapid fouling of the heat exchangers. The treated oil may be oil 'treated' in accordance with the present invention. Alternatively, the oil may have been treated using a conventional coalescing treater. The process is carried out in conjunction with a novel compartmentalized flash separator/soak vessel having a bottom outlet for combined treated oil and visbroken residuum. The bottom outlet is connected to an indirect heat exchanger train ("the recycle exchanger train") adapted to provide a substantially conservative uniform flux rate of heat exchange, whereby part of the visbroken residuum stream may be heated to a uniform and controlled temperature and recycled to the upper end of the central soak chamber of the flash separator vessel. One suitable heating system for this purpose involves a train of shell and tube heat exchangers supplied with burner-heated eutectic salt mixture heating medium.

In another preferred aspect, the treated product from the treater is pre-heated by indirect heat exchange with the overhead light hydrocarbon vapour stream from the visbreaking vessel, to thereby partly condense said vapour stream. This heat exchange is carried out in an inlet process-to-process heat exchanger train. The treated product is now at a temperature which is greater than the treater temperature but substantially less than the temperature of the stream of visbroken residuum and treated oil being recycled to the visbreaking flash separator/soak vessel.

The flash separator vessel is formed with an internal elongate tubular member, such as an elongate ring, extending parallel to the vessel side wall in spaced relation therewith through the intermediate length of the vessel, to form a central soak chamber, an outer annular chamber and a bottom zone in which the streams from the two open-ended compartments may mix. The pre-heated treated product stream from the inlet exchanger train is fed into the annular chamber and the recycled residuum from the recycle exchanger train is fed into the soak chamber. Light hydrocarbon fractions contained in the treated oil and the partially thermally decomposed recycled residuum are evaporated and recovered as overhead vapour. The relatively cool treated oil in the annulus functions to keep the vessel ring at a temperature less than that prevailing in the centre of the soak chamber and below the coking temperature of the oil, to thereby reduce, or eliminate, the extent of coke accumulation on the ring.

Stated otherwise, heat is transferred from the hot liquid in the soak chamber, through the annular wall of the ring, to the cooler liquid in the annular chamber. This heat transfer occurs along the vertical length of the ring. This provides a mechanism for cooling the liquid in the soak chamber to maintain it at mild visbreaking temperatures. By isolating the incoming relatively cool treated oil in the annular chamber from the incoming relatively hot recycled visbroken resid, premature quenching of the resid is avoided. By commingling the treated oil and visbroken residuum in the base of the vessel, the former does quench the latter at that point to terminate visbreaking and associated coke production. By providing open-ended passages or chambers and a vented common flash zone at the top end of the vessel, provision is made for flashing and removal of light ends from the two incoming streams.

Broadly stated, the invention encompasses a process for visbreaking heavy oil, which is substantially free of water and solids, in a closed upstanding flash separator, said separator having an upstanding tubular member mounted therein and extending longitudinally thereof, said tubular member being spaced inwardly from the separator's side wall and terminating short of the separator's top and bottom ends, whereby the separator provides a central open-ended soak chamber, an outer open-ended annular chamber that is coextensive with the soak chamber and encircles it, and flash and quench chambers at the upper and lower ends respectively of the soak and annular chambers, said flash and quench chambers each communicating with both the soak and annular chambers, said process comprising: (a) feeding a stream of heavy oil into the top end of the annular chamber, said heavy oil having an elevated temperature that is in the range of about 220° F. to about 600° F.; (b) feeding a recycle stream, comprising a mixture of visbroken residuum and heavy oil and having a temperature in the range of about 750° F. to about 800° F., into the top end of the soak chamber; (c) removing light hydrocarbons flashed from the heavy oil and the recycled mixture streams in the form of an overhead vapour stream; (d) passing the heavy oil and the recycled mixture streams separately and co-currently down through the annular and soak chambers respectively, so that the liquid in the soak chamber immediately adjacent the tubular member wall surface is cooled by heat exchange, through the wall of the tubular member, with the liquid moving through the annular chamber; (e) commingling the liquids, issuing from the bottom ends of the annular and soak chambers, in the quench chamber, to quench the visbreaking reaction; (f) withdrawing a product mixture of visbroken residuum and heavy oil at a controlled rate from the quench chamber; and (g) recycling part of the product mixture and heating it to 750°-800° F., to provide the recycle stream of step (b).

DESCRIPTION OF THE PREFERRED EMBODIMENT

Figure 1:
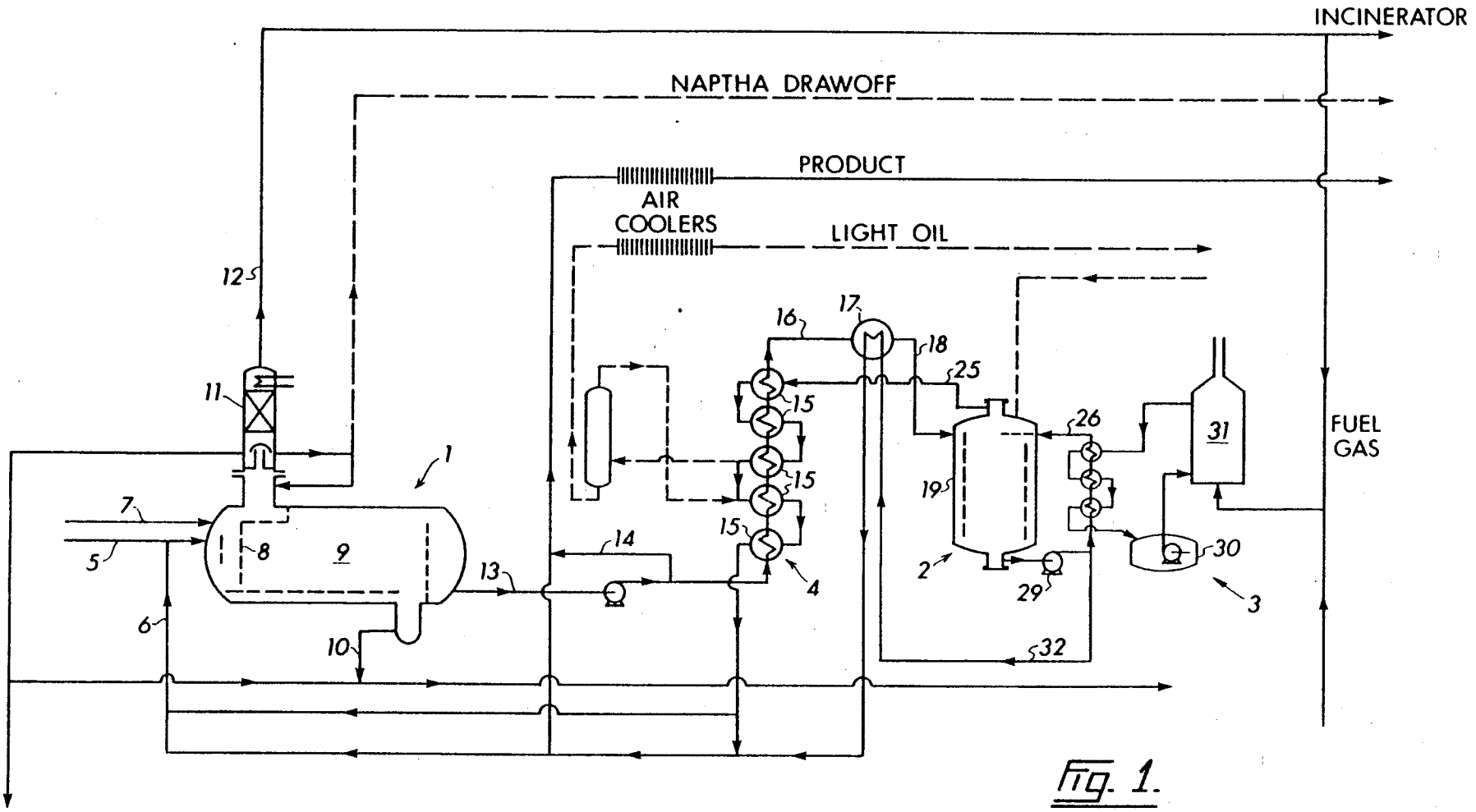
FIG. 1 is a schematic depicting the process circuit of a preferred embodiment of the invention.

Having reference to the accompanying drawings, the heavy oil partial up-grading plant and process for the treatment of a heavy oil production stream will now be described. It will be appreciated, although not illustrated in the drawings, that the apparatus is sized and adapted for skid-mounting, so as to be readily transportable.

A typical circuit, illustrated in FIG. 1, comprises a coalescing treater 1, a flash separator 2, a eutectic salt heating unit 3, (or recycle exchanger train) and a process-to-process heat exchanger train 4.

As shown, production from the wells is introduced to the circuit through line 5 and is passed into treater 1. The production stream has previously been subjected to a free water knockout treatment in a conventional vessel (not shown). The heavy oil feedstock entering treater 1 typically has a water content of about 10% (by wt.), and solids content of about 5%. Its temperature typically is about 120°-140° F. (50° to 60° C.). However, at the beginning of the production phase in a huff and puff system its temperature may be higher.

Also introduced through line 5 into treater 1 is a process recycle stream, fed into line 5 from line 6. The process recycle stream comprises, in combination, partially condensed overhead light hydrocarbon vapour obtained from flash separator 2 (as will be described hereinafter) and, optionally, hot residuum bled from the flash separator circuit (also to be further described hereinafter). The ratio of overhead vapour component content and residuum component content will vary, depending on process parameter variations and material and heat balance requirements, as would be evident to one skilled in the art. However, the ratio of heavy oil feedstock to process recycle stream is typically maintained at approximately 3:1. The temperature of the process recycle stream is typically between about 250°-300° F. (120° and 150° C.).

The process recycle stream, therefore, because of its high temperature, gaseousness, and light hydrocarbon content, heats, mixes and dilutes the heavy oil feedstock. Thus the requirement for heating means such as fire tubes in the treater may be eliminated or significantly reduced. Addition of the diluent assists in phase separation of the heavy oil components. And the turbulence induced in the front end of the treater by the addition of the gaseous recycle stream assists in disseminating emulsion-breaking chemicals which would normally be introduced into the treater in conventional fashion. Such emulsion-breaking (or 'treating') chemicals may be added as required to the treater 1 through line 7.

Figure 3:
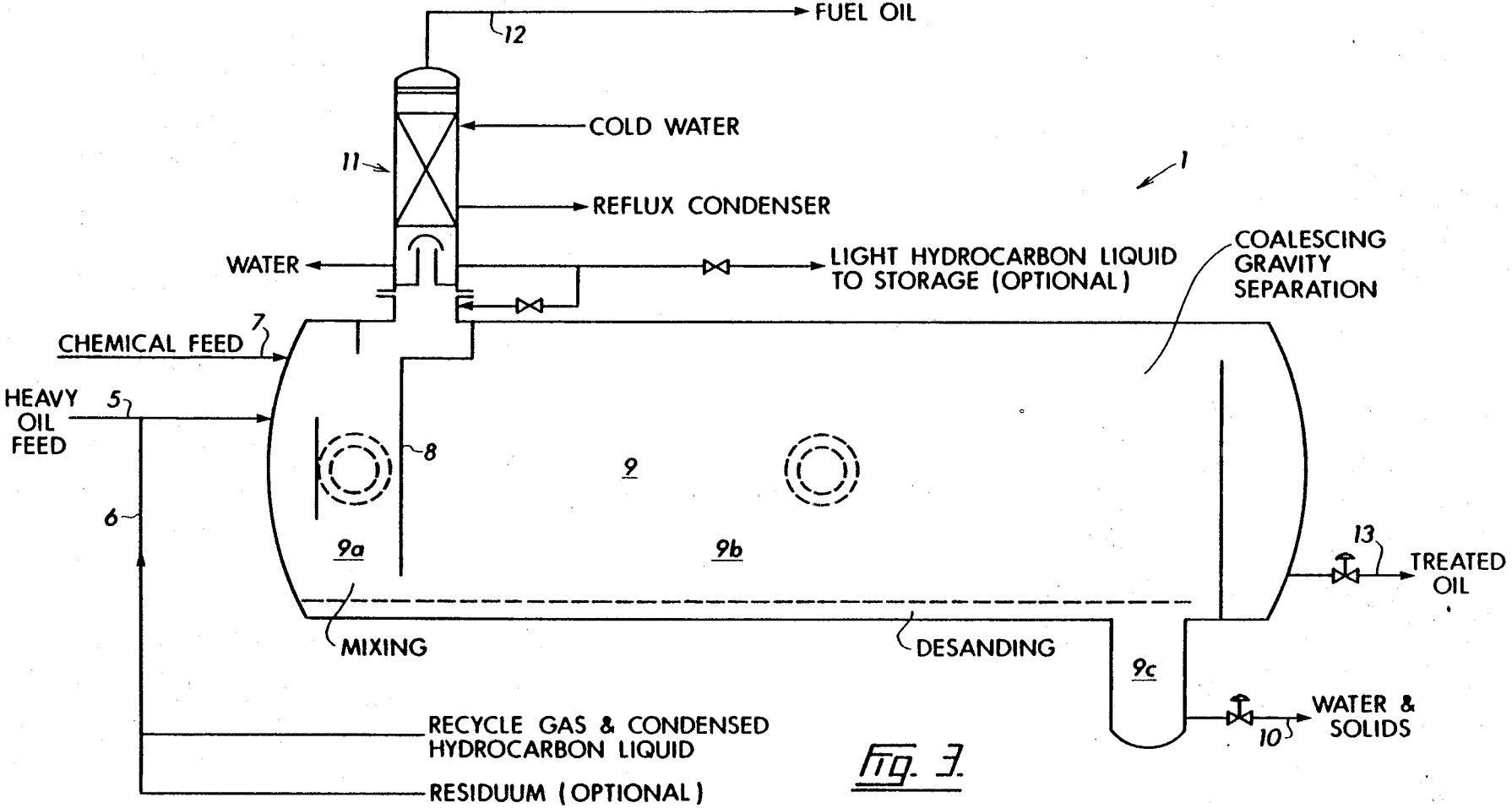
FIG. 3 is a side-sectional view of the treater vessel employed in the circuit of FIG. 1.

Treater 1, as shown in FIG. 3, comprises a vessel having a baffle 8 affixed as illustrated, dividing the internal chamber 9 of said vessel into a front end mixing zone 9a and a downstream coalescing/phase-separating zone 9b. A sump zone 9c is located at the base of the vessel. Water and solids which settle and collect therein are withdrawn from the vessel through line 10.

Conditions in the treater 1 are typically maintained at a temperature of 180°-220° F. (85°-105° C.) and a pressure of 15-20 psig.

A reflux condenser 11 is mounted on the upper section of treater 1, for condensing lighter hydrocarbon distillates and returning them to the treater. As a result, overhead losses of these distillates are minimized and further dilution of the treated oil is achieved. The remaining gas is used as fuel. The reflux condenser 11 contains a conventional cooling coil assembly (not shown). With high asphaltic oil, it may be desirable to draw off reflux condensate to thereby reduce the tendency for paraffins and unsaturates to form precipitates in the treater. Operation of the reflux condenser 11 is controlled by varying coolant flow in response to variations in treater temperature and fuel requirements. As an additional refinement, a heating coil is provided to augment the temperature of the treater should this be necessary during start-up.

Effluent gases leave the top of the reflux condenser 11 through line 12.

The treated oil leaves the treater 1 through line 13. Up to 50% of the treated oil can be bled off via line 14 as product for market when all the residuum is back fed to the treater as opposed to downstream blending.

After withdrawal of product oil, the remainder of the treated oil is passed to the process heat exchanger train 4. There it is heated to approximately 350°-400° F. (175° to 205° C.) by indirect countercurrent heat exchange with the overhead light hydrocarbon vapour stream leaving the flash separator 2.

More particularly, heat exchanger train 4 comprises four or five serially connected shell-and-tube heat exchangers 15. As will be evident to one skilled in the art, by providing each exchanger with a product bleed line (not shown) there is the possibility of providing a means of separating a series of rough petroleum cuts from the condensing vapours. As stated earlier, the exit temperature of the treated oil is about 350°-400° F. (175° to 205° C). The inlet temperature of the vapour stream is about 700° F. (370° C.) and its exit temperature is about 240° F. (115° C.). The train 4 is operated at a pressure of 45 psig±10 (310 kPa±70).

From the last heat exchanger 15, the heated treated oil is passed through line 16 to a gas/liquid heat exchanger 17. There the temperature of the oil is further raised up to 600° F. (315° C.) by indirect heat exchange with residuum bled from the separator circuit.

The heated treated oil then flows via line 18 into the flash separator 2.

Figure 2:
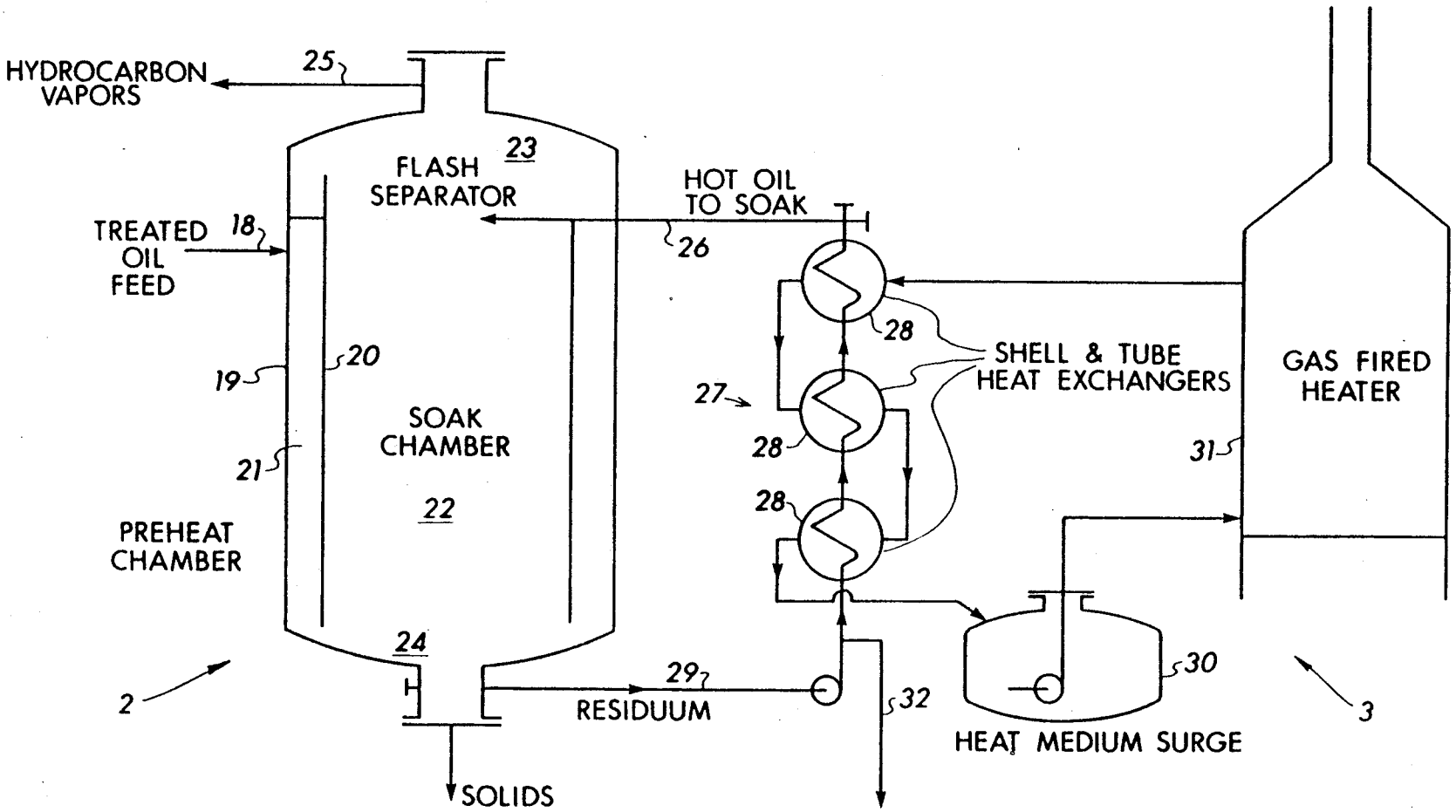
FIG. 2 is a detailed sectional side view of the flash separator and eutectic salt heating system employed in the circuit of FIG. 1.

The flash separator 2, as shown in FIG. 2, comprises an upright cylindrical vessel 19 having an internal stainless steel ring 20 mounted therein in spaced relation from the side wall of the vessel. The ring 20 extends through most of the length of the vessel but ends short of the top and bottom transverse walls thereof. Thus the vessel walls and the ring 20 combine to form an open-ended outer annular chamber 21, an open-ended central soak chamber 22, a top chamber 23 communicating with the annular and soak chambers 21, 22, and a bottom chamber 24 also communicating with said chambers 21, 22. Retention times in the soak chamber are controlled by level and recycle rate.

Turning now to the lines connecting the flash separator 2 with the other units of the system, the line 18, from the outlet end of the heat exchanger train 4, communicates with the annular chamber 21. A vapour outlet line 25 extends from the upper chamber 23 and communicates with the inlet end of the heat exchanger train 4. A recycle line 26 extends from the outlet end of a train 27 of eutectic salt heater exchangers 28 and communicates with the upper end of the soak chamber 22. And a line 29 connects the base of the flash separator bottom chamber 24 with the inlet end of the exchanger train 27. The exchanger train 27 is supplied with hot eutectic salt mixture from a reservoir 30 and heater 31 circuit, as shown. The line 29, carrying a mixture of visbroken residuum and flashed treated oil (referred to as "combined product") connects with the line 32. A portion of the hot combined product is withdrawn through line 32, passed through heat exchanger 17, and/or returned to the treater 1 through lines 6 and 5.

In the operation of the flash separator 2, treated oil is partially flashed in the annular chamber 21 and then combined in the bottom quench chamber 24 with partially visbroken residuum issuing from the soak chamber 22, to thereby quench the visbreaking reaction. Part of the resulting combined product is then recycled through the salt heater exchanger train 27 and uniformly heated to about 750°-800° F. (400°-425° C.). This heated combined product portion is then introduced into the soak chamber 22 and temporarily retained therein to effect partial thermal decomposition or visbreaking. The overhead vapours from the separator are passed to the heat exchanger train 4, as previously mentioned.

The flash separator is operated to maintain the following preferred combination of conditions, namely:

| | |
|---|---|
| soak temperature | 730-800° F. |
| pressure | 30-55 psig |
| retention time | 15-90 minutes |

From the foregoing, the following advantages will be noted:

- visbreaking is preferably conducted at process conditions which can be characterized as mild and which are non-conductive to coke formation;
- there are provided concentric contiguous chambers separated by a heat-conducting ring, whereby there is heat exchange from the soak chamber liquid to the annular chamber liquid, thereby assisting in maintaining mild temperature in the soak chamber liquid undergoing visbreaking, to reduce coking;
- the retention time in the separator can be controlled by the withdrawal rate of pump 29, to thereby avoid excessive retention that can lead to coking;
- recycling of residuum can be controlled with the pump 29 to add heat slowly and reduce coking;
- the provision of the reflux condenser, the controlled recycle of separator product streams to the treater to provide heating, mixing and dilution, and control of residuum heating in the heater circuit of the flash separator all contribute to provide a flexible process that is adapted to cope with feedstock variations; and
- the process and apparatus are relatively simple and are adapted for use preferably in the oilfield site environment.

It also needs to be understood that, while the process has been developed in conjunction with heavy oil feedstocks having an API gravity in the order of 10–16, it is applicable with utility to medium crudes as well. Thus the phrase 'heavy oil' used in this specification is to be given a wide interpretation.

The following example is included to demonstrate the operability of the visbreaking process.

EXAMPLE

Figure 4:
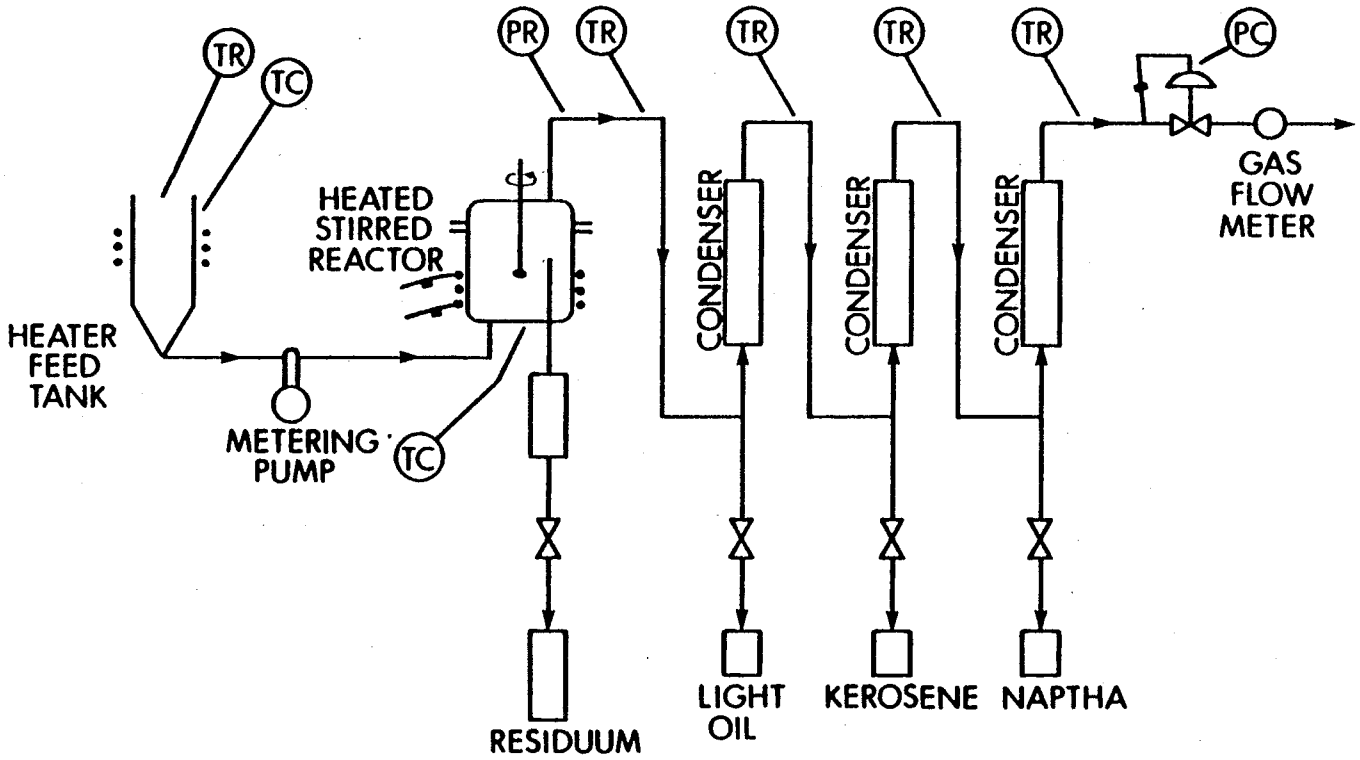
FIG. 4 is a schematic showing the pilot plant used for the visbreaking tests.

The tests were conducted on a bench scale pilot plant using the set-up shown in FIG. 4. The tests were run on a batch and continuous basis. The results obtained are given in Table I herebelow.

TABLE I

| | Fort Kent (continous) | | Glen Nevis (continous) | | | Cold Lake (batch) | |
|---|---|---|---|---|---|---|---|
| | Feed | Product | Feed | Product Run 1 | Product Run 2 | Feed | Product |
| API gravity | 13.6 | 17.0 | 17.5 | 18.9 | 23.7 | 11.1 | 15.9 |
| Viscosity cps @ 20°C. | 14500 | 133 | 514.2 | 149 | 47 | 2071 @ 50° C. | 909 |
| Soak Time (mins.) | | 34 | | 43 | 55 | | 33 |
| Soak Temp °C. | | 420 | | 402 | 407 | | 425 |
| System Pres. kPa (g) | | 270 | | 276 | 276 | | 345 |
| Products wt % | | | | | | | |
| Gas | | 3.1 | | | | | 5.1 |
| IBP-200° C. | | 20.1 | 12.3 | | | | |
| 200–350° C. | | 15.8 | 56.1 | | | | |
| 350–525° C. | | 29.6 | 31.6 | | | | @ +425° C. |
| +525° C. | | 31.1 | ↓ | | | | 51.9 |
| Insolubles (coke) | | 0.2 | | | | | 0.4 |
| Water | | 0.1 | | | | | 0.7 |
| Recovery Efficiency | | | | | | | |
| Wt. % liquids | | 96.6 | | | | | 92.2 |
| Vol. $ liquids | | 98.9 | | | | | 95.3 |
| Gas Analysis Vol. % | | | | | | | |
| Hydrogen | | 11.3 | | | 13.9 | | 7.2 |
| Carbon Monoxide | | 1.7 | | | 1.6 | | 1.6 |
| Carbon Dioxide | | 1.7 | | | 0.43 | | 1.1 |
| Hydrogen Sulphide | | 26.4 | | | 1.0 | | 20.7 |
| Methane | | 26.8 | | | 34.4 | | 33.9 |
| Ethane | | 10.7 | | | 16.7 | | 12.7 |
| Ethylene | | 0.9 | | | 3.9 | | 0.9 |
| Propane | | 8.5 | | | 10.7 | | 7.8 |
| Propylene | | 4.1 | | | 5.4 | | 4.6 |
| Butane | | 3.3 | | | 4.1 | | 2.0 |
| Iso-Butane | | 0.8 | | | 0.9 | | 0.5 |
| Butene | | 1.8 | | | 3.1 | | 2.4 |
| Pentane | | 1.3 | | | 1.1 | | 0.4 |
| Iso-Pentane | | 0.7 | | | 0.9 | | 0.3 |

The embodiments of the invention in which an exclusive property or privilege is claimed are defined as follows:

1. A process for visbreaking heavy oil, which is substantially free of water and solids, in a closed upstanding flash separator, said separator having an upstanding tubular member mounted therein and extending longitudinally thereof, said tubular member being spaced inwardly from the separator's side wall and terminating short of the separator's top and bottom ends, whereby the separator provides a central open-ended soak chamber, an outer open-ended annular chamber that is coextensive with the soak chamber and encircles it, and flash and quench chambers at the upper and lower ends respectively of the soak and annular chambers, said flash and quench chambers each communicating with both the soak and annular chambers, said process comprising:

(a) feeding a stream of heavy oil into the top end of the annular chamber, said heavy oil having an elevated temperature that is in the range of about 220° F. to about 600° F.;

(b) feeding a recycle stream, comprising a mixture of visbroken residuum and heavy oil and having a temperature in the range of about 750° F. to about 800° F., into the top end of the soak chamber;

(c) removing light hydrocarbons flashed from the heavy oil and the recycled mixture streams in the form of an overhead vapour stream;

(d) passing the heavy oil and the recycled mixture streams separately and co-currently down through the annular and soak chambers respectively, so that the liquid in the soak chamber immediately adjacent the tubular member wall surface is cooled by heat exchange, through the wall of the tubular member, with the liquid moving through the annular chamber;

(e) commingling the liquids, issuing from the bottom ends of the annular and soak chambers, in the quench chamber, to quench the visbreaking reaction;

(f) withdrawing a product mixture of visbroken residuum and heavy oil at a controlled rate from the quench chamber; and (g) recycling part of the product mixture and heating it to 750°–800° F., to provide the recycle stream of step (b).

2. The process as set forth in claim 1 comprising:

preheating the heavy oil, prior to introducing it into the separator, by indirect heat exchange with the overhead light hydrocarbon vapour stream leaving the flash separator.

3. The process as set forth in claim 1 wherein:

the recycled stream is substantially uniformly and indirectly heated during recycling using a eutectic salt mixture heating medium.

4. The process as set forth in claim 2 wherein:

the recycled stream is substantially uniformly and indirectly heated during recycling using a eutectic salt mixture heating medium.

5. The process as set forth in claim 1 wherein the pressure maintained in the separator is in the range of between 30 psig and 55 psig and the retention time in the soak chamber is in the range of about 15–90 minutes.

6. The process as set forth in claim 2 wherein the pressure maintained in the separator is in the range of between 30 psig and 55 psig and the retention time in the soak chamber is in the range of about 15–90 minutes.

7. The process as set forth in claim 3 wherein the pressure maintained in the separator is in the range of between 30 psig and 55 psig and the retention time in the soak chamber is in the range of about 15–90 minutes.

8. The process as set forth in claim 4 wherein the pressure maintained in the separator is in the range of between 30 psig and 55 psig and the retention time in the soak chamber is in the range of about 15–90 minutes.

9. The process as set forth in claim 1 comprising:

partly condensing the overhead vapour stream by heat exchange with the incoming heavy oil feed for the separator, to produce a partly condensed vapour stream;

supplying as-produced heavy oil containing water and solids to a coalescing treater;

contacting the as-produced oil with the partly condensed vapour stream in the treater to heat and dilute the oil; and temporarily retaining the mixture in the treater to settle and separate contained water and solids and produce the feedstock for the separator.

10. The process as set forth in claim 3 comprising:

partly condensing the overhead vapour stream by heat exchange with the incoming heavy oil feed for the separator, to produce a partly condensed vapour stream;

supplying as-produced heavy oil containing water and solids to a coalescing treater;

contacting the as-produced oil with the partly condensed vapour stream in the treater to heat and dilute the oil; and temporarily retaining the mixture in the treater to settle and separate contained water and solids and produce the feedstock for the separator.

11. The process as set forth in claim 5 comprising:

partly condensing the overhead vapour stream by heat exchange with the incoming heavy oil feed for the separator, to produce a partly condensed vapour stream;

supplying as-produced heavy oil containing water and solids to a coalescing treater;

contacting the as-produced oil with the partly condensed vapour stream in the treater to heat and dilute the oil; and temporarily retaining the mixture in the treater to settle and separate contained water and solids and produce the feedstock for the separator.

* * * * *